US009330605B2

(12) United States Patent
Park

(10) Patent No.: US 9,330,605 B2
(45) Date of Patent: May 3, 2016

(54) ORGANIC LIGHT EMITTING DISPLAY AND METHOD OF COMPENSATING FOR THRESHOLD VOLTAGE THEREOF

(71) Applicant: LG Display Co., Ltd., Seoul (KR)

(72) Inventor: Kwangmo Park, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/547,387

(22) Filed: Nov. 19, 2014

(65) Prior Publication Data

US 2015/0138179 A1 May 21, 2015

(30) Foreign Application Priority Data

Nov. 20, 2013 (KR) ..... 10-2013-0141334

(51) Int. Cl.
*G09G 3/32* (2006.01)

(52) U.S. Cl.
CPC ..... *G09G 3/3291* (2013.01); *G09G 3/3233* (2013.01); *G09G 3/3258* (2013.01); *G09G 2300/043* (2013.01); *G09G 2300/0819* (2013.01); *G09G 2300/0842* (2013.01); *G09G 2310/08* (2013.01); *G09G 2320/0233* (2013.01)

(58) Field of Classification Search
CPC ..... G09G 2320/0233; G09G 2310/08
See application file for complete search history.

(56) References Cited

U.S. PATENT DOCUMENTS

2008/0231562 A1* 9/2008 Kwon ..... G09G 3/3233 345/77
2008/0252568 A1* 10/2008 Kwon ..... G09G 3/3233 345/76
2011/0227505 A1* 9/2011 Park ..... H05B 33/0896 315/297
2011/0279437 A1* 11/2011 Komiya ..... G09G 3/3233 345/212
2013/0050292 A1 2/2013 Mizukoshi
2013/0162617 A1 6/2013 Yoon et al.
2013/0201173 A1* 8/2013 Chaji ..... G09G 3/3233 345/212
2014/0168290 A1* 6/2014 Yang ..... G09G 3/3233 345/691
2015/0029171 A1* 1/2015 Jo ..... G09G 3/3258 345/212
2015/0130859 A1* 5/2015 Yang ..... G09G 3/3266 345/690

OTHER PUBLICATIONS

Communication dated Mar. 6, 2015 from the European Patent Office in counterpart European application No. 14192646.9-1904.

* cited by examiner

*Primary Examiner* — Ryan A Lubit
(74) *Attorney, Agent, or Firm* — Morgan, Lewis & Bockius LLP

(57) ABSTRACT

An organic light emitting display and a method of compensating for a threshold voltage thereof are disclosed. The organic light emitting display includes a display panel including a plurality of pixels, a gate driving circuit generating first and second threshold voltage sensing gate pulses, a data driving circuit which supplies a threshold voltage sensing data voltage to the pixels in response to the first threshold voltage sensing gate pulse and detects a source voltage of a driving thin film transistor (TFT) of each pixel as a sensing voltage in response to the second threshold voltage sensing gate pulse, and a timing controller which modulates input digital video data for the image display based on a change in the sensing voltage and generates digital compensation data.

15 Claims, 12 Drawing Sheets

(A) Related art (B)

ORGANIC LIGHT EMITTING DISPLAY AND METHOD OF COMPENSATING FOR THRESHOLD VOLTAGE THEREOF

This application claims the benefit of Korea Patent Application No. 10-2013-0141334 filed on Nov. 20, 2013, which is incorporated herein by reference for all purposes as if fully set forth herein.

BACKGROUND

1. Field of the Invention

Embodiments of the invention relate to an active matrix organic light emitting display, and more particularly, to an organic light emitting display and a method of compensating for a threshold voltage thereof.

2. Discussion of the Related Art

An active matrix organic light emitting display includes organic light emitting diodes (hereinafter, abbreviated as "OLEDs") capable of emitting light. Such an active matrix organic light emitting display has advantages of a fast response time, a high light emitting efficiency, a high luminance, a wide viewing angle, and the like.

The OLED serving as a self-emitting element typically includes an anode electrode, a cathode electrode, and an organic compound layer formed between the anode electrode and the cathode electrode. The organic compound layer includes a hole injection layer HIL, a hole transport layer HTL, a light emitting layer EML, an electron transport layer ETL, and an electron injection layer EIL. When a driving voltage is applied to the anode electrode and the cathode electrode, holes passing through the hole transport layer HTL and electrons passing through the electron transport layer ETL move to the light emitting layer EML and form excitons. As a result, the light emitting layer EML generates visible light.

The organic light emitting display arranges pixels, each including an OLED, in a matrix form, and adjusts a luminance of the pixels depending on a gray scale of video data. Each pixel typically includes a driving thin film transistor (TFT) for controlling a driving current flowing in the OLED. It is preferable that electrical characteristics (including a threshold voltage, mobility, etc.) of the driving TFT are equally designed in all of the pixels. However, in practice, the electrical characteristics of the driving TFTs of the pixels are not uniform due to various causes. A deviation between the electrical characteristics of the driving TFTs results in a luminance deviation between the pixels.

Various compensation methods of compensating for the threshold voltage of the driving TFT are known. FIGS. 1 and 2 show one of the various compensation methods. An external compensation method illustrated in FIGS. 1 and 2 operates a driving TFT DT in a source follower manner and senses a threshold voltage Vth of the driving TFT DT. The source follower manner determines a change in the threshold voltage Vth based on a sensing value input to an analog-to-digital converter (ADC). However, accurate sensing of the threshold voltage Vth of the driving TFT DT using the source follower manner has to be performed after the driving TFT DT is turned off and a drain-source current Ids of the driving TFT DT becomes zero. Therefore, a long time Tx is required to sense the threshold voltage Vth.

More specifically, a sensing data voltage Vdata greater than the threshold voltage Vth is applied to a gate electrode of the driving TFT DT, so as to sense the threshold voltage Vth. When an initialization voltage Vref is applied to a source electrode of the driving TFT DT, the driving TFT DT is turned on because a gate-source voltage Vgs of the driving TFT DT is greater than the threshold voltage Vth. In this instance, the drain-source current Ids of the driving TFT DT depends on a difference Vgs between a gate voltage Vg (VN1) of the driving TFT DT and a source voltage Vs (VN2) of the driving TFT DT. In an initial sensing period, in which the source voltage Vs (VN2) of the driving TFT DT starts to increase, because the gate-source voltage Vgs of the driving TFT DT is large, a channel resistance of the driving TFT DT is small. As a result, the drain-source current Ids of the driving TFT DT is large. However, as the source voltage Vs (VN2) of the driving TFT DT gradually increases, the gate-source voltage Vgs of the driving TFT DT decreases. Therefore, the channel resistance of the driving TFT DT increases. As a result, the drain-source current Ids of the driving TFT DT decreases. When the drain-source current Ids of the driving TFT DT decreases, a charge amount accumulated in a sensing capacitor Cx decreases. Therefore, a time required for the gate-source voltage Vgs of the driving TFT DT to become the threshold voltage Vth increases. As the sensing time of the threshold voltage Vth increases, the amount of time available for displaying an image (e.g., the image display time) is reduced. Thus, in order to increase the image display time, the sensing time of the threshold voltage Vth needs to be reduced.

SUMMARY

Embodiments of the invention provide an organic light emitting display and a method of compensating for a threshold voltage thereof capable of reducing a sensing time of a threshold voltage when the threshold voltage of a driving thin film transistor (TFT) is sensed in a source follower manner.

In an embodiment, there is an organic light emitting display comprising a display panel including a plurality of pixels, a gate driving circuit configured to generate a first threshold voltage sensing gate pulse and a second threshold voltage sensing gate pulse for operating the pixels using a source follower manner, a data driving circuit configured to supply a threshold voltage sensing data voltage to the pixels in response to the first threshold voltage sensing gate pulse and detect a source voltage of a driving thin film transistor (TFT) of each pixel as a sensing voltage in response to the second threshold voltage sensing gate pulse, and a timing controller configured to modulate input digital video data for the image display based on a change in the sensing voltage and generate digital compensation data, wherein a sensing period for sensing a threshold voltage of the driving TFT is divided into a first period and a second period following the first period, wherein a gate voltage of the driving TFT of each pixel is held at one or more high levels in the first period of the sensing period and is held at a reference level lower than the high level in the second period of the sensing period.

In another embodiment, there is a method of compensating for a threshold voltage of an organic light emitting display including a display panel including a plurality of pixels, the method comprising generating a first threshold voltage sensing gate pulse and a second threshold voltage sensing gate pulse for operating the pixels using a source follower manner, supplying a threshold voltage sensing data voltage to the pixels in response to the first threshold voltage sensing gate pulse and detecting a source voltage of a driving thin film transistor (TFT) of each pixel as a sensing voltage in response to the second threshold voltage sensing gate pulse, and modulating input digital video data for the image display based on a change in the sensing voltage and generating digital compensation data, wherein a sensing period for sensing a threshold voltage of the driving TFT is divided into a first period and a second period following the first period, wherein a gate voltage of the driving TFT of each pixel is held at one or more high levels in the first period of the sensing period and is held at a reference level lower than the high level in the second period of the sensing period.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of embodiments of the invention. In the drawings.

DETAILED DESCRIPTION OF THE EMBODIMENTS

Reference will now be made in detail to embodiments of the invention, examples of which are illustrated in the accompanying drawings. Wherever possible, the same or like reference numbers will be used throughout the drawings to refer to the same or like parts. Detailed description of known art may be omitted if it is determined that the art can mislead the embodiments of the invention.

Example embodiments of the invention will be described with reference to FIGS. 3 to 12.

Figure 3:
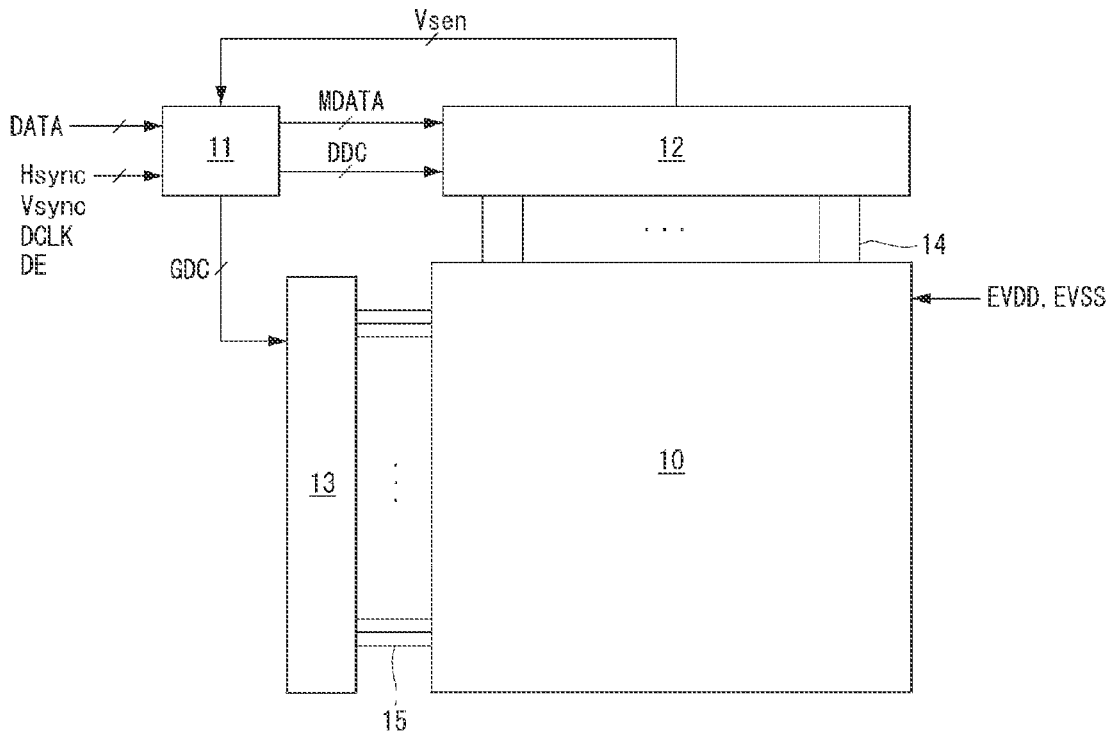
FIG. 3 is a block diagram of an organic light emitting display according to an example embodiment of the invention.
Figure 4:
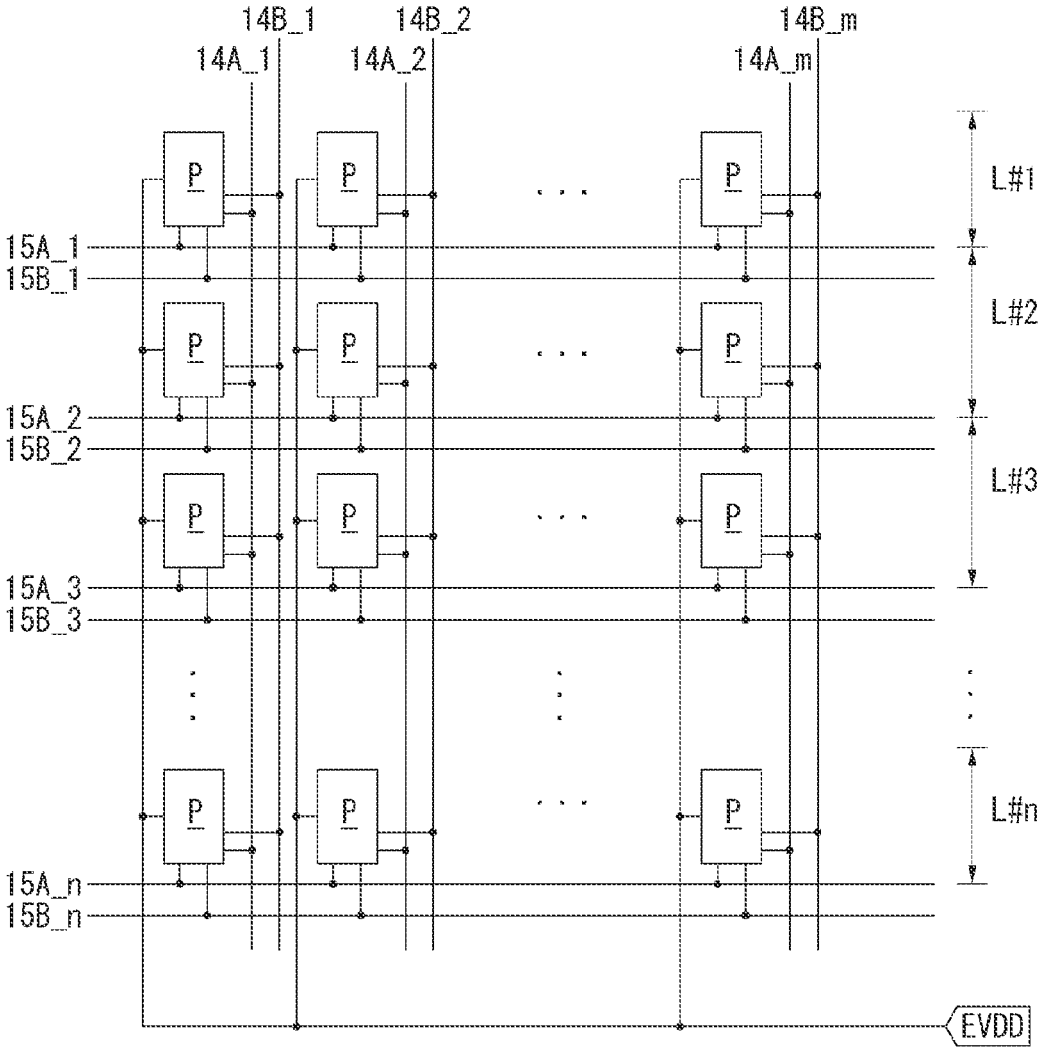
FIG. 4 shows a pixel array of a display panel.

FIG. 3 is a block diagram of an organic light emitting display according to an example embodiment of the invention. FIG. 4 shows a pixel array of a display panel.

As shown in FIGS. 3 and 4, the organic light emitting display according to the embodiment may include a display panel 10, a data driving circuit 12, a gate driving circuit 13, and a timing controller 11.

The display panel 10 may include a plurality of data lines 14, a plurality of gate lines 15 crossing the data lines 14, and a plurality of pixels P respectively arranged at crossings of the data lines 14 and the gate lines 15 in a matrix form.

The data lines 14 may include m data voltage supply lines 14A_1 to 14A_m and m sensing voltage readout lines 14B_1 to 14B_m, where m is a positive integer. The gate lines 15 may include n first gate lines 15A_1 to 15A_n and n second gate lines 15B_1 to 15B_n, where n is a positive integer.

Each pixel P may be connected to one of the data voltage supply lines 14A_1 to 14A_m, one of the sensing voltage readout lines 14B_1 to 14B_m, one of the first gate lines 15A_1 to 15A_n, and one of the second gate lines 15B_1 to 15B_n. Each pixel P may receive a data voltage through the data voltage supply line, may receive a first threshold voltage sensing gate pulse through the first gate line, may receive a second threshold voltage sensing gate pulse through the second gate line, and may output a sensing voltage through the sensing voltage readout line. For example, in a pixel array shown in FIG. 4, the pixels P sequentially operate based on each of horizontal lines L#1 to L#n in response to the first threshold voltage sensing gate pulse received from the first gate lines 15A_1 to 15A_n in a line sequential manner and the second threshold voltage sensing gate pulse received from the second gate lines 15B_1 to 15B_n in the line sequential manner. The pixels P on the same horizontal line, on which an operation is activated, may receive a threshold voltage sensing data voltage from the data voltage supply lines 14A_1 to 14A_m and output the sensing voltage to the sensing voltage readout lines 14B_1 to 14B_m.

Each pixel P may receive a high potential driving voltage EVDD and a low potential driving voltage EVSS from a power generator (not shown). Each pixel P according to an embodiment of the invention may include an organic light emitting diode (OLED), a driving thin film transistor (TFT), first and second switch TFTs, and a storage capacitor for the external compensation. The TFTs constituting the pixel P may be implemented as a p-type or an n-type. Further, semiconductor layers of the TFTs constituting the pixel P may contain amorphous silicon, polycrystalline silicon, or oxide.

In a sensing drive for sensing a threshold voltage of the driving TFT, the data driving circuit 12 may supply the threshold voltage sensing data voltage to the pixels P in response to the first threshold voltage sensing gate pulse. Further, the data driving circuit 12 may convert the sensing voltages received from the display panel 10 through the sensing voltage readout lines 14B_1 to 14B_m into digital values and supply the digital sensing voltages to the timing controller 11. In an image display drive for the image display, the data driving circuit 12 may convert digital compensation data MDATA received from the timing controller 11 into an image display data voltage based on a data control signal DDC and supply the image display data voltage to the data voltage supply lines 14A_1 to 14A_m.

The gate driving circuit 13 may generate a gate pulse based on a gate control signal GDC. The gate pulse may include the first threshold voltage sensing gate pulse, the second threshold voltage sensing gate pulse, a first image display gate pulse, and a second image display gate pulse. In the sensing drive of the threshold voltage, the gate driving circuit 13 may supply the first threshold voltage sensing gate pulse to the first gate lines 15A_1 to 15A_n in the line sequential manner and also may supply the second threshold voltage sensing gate pulse to the second gate lines 15B_1 to 15B_n in the line sequential manner. In the image display drive, the gate driving circuit 13 may supply the first image display gate pulse to the first gate lines 15A_1 to 15A_n in the line sequential manner and also may supply the second image display gate pulse to the second gate lines 15B_1 to 15B_n in the line sequential manner. The gate driving circuit 13 may be directly formed on the display panel 10 through a gate driver-in panel (GIP) process.

The timing controller 11 may generate the data control signal DDC for controlling operation timing of the data driving circuit 12 and the gate control signal GDC for controlling operation timing of the gate driving circuit 13 based on timing signals, such as a vertical sync signal Vsync, a horizontal sync signal Hsync, a data enable signal DE, and a dot clock DCLK. Further, the timing controller 11 may modulate input digital video data DATA based on the digital sensing voltages received from the data driving circuit 12 and generate the digital compensation data MDATA for compensating for a deviation between the threshold voltages of the driving TFTs. The timing controller 11 may then supply the digital compensation data MDATA to the data driving circuit 12.

The timing controller 11 according to an embodiment of the invention may divide a sensing period for sensing the threshold voltage into a first period and a second period following the first period. The timing controller 11 may control an operation of the data driving circuit 12 and an operation of the gate driving circuit 13 in the first and second periods, thereby reducing the time required to sense the threshold voltage. For this, an embodiment of the invention may not uniformly hold a gate voltage of the driving TFT included in the pixel P at a predetermined level throughout the sensing period, in contrast to the related art. For example, an embodiment of the invention may hold the gate voltage of the driving TFT at one or more high levels in the first period of the sensing period, and may hold the gate voltage of the driving TFT at a reference level lower than the high level in the second period of the sensing period. Furthermore, the embodiment may increase a gate-source voltage of the driving TFT and reduces a channel resistance of the driving TFT in the first period of the sensing period, thereby increasing an amount of a current flowing between a drain electrode and a source electrode of the driving TFT. As the amount of the current flowing between the drain electrode and the source electrode of the driving TFT increases, the source voltage of the driving TFT may rapidly increase. Therefore, the time it takes for the gate-source voltage of the driving TFT to reach a threshold voltage of the driving TFT may be reduced.

Figure 5:
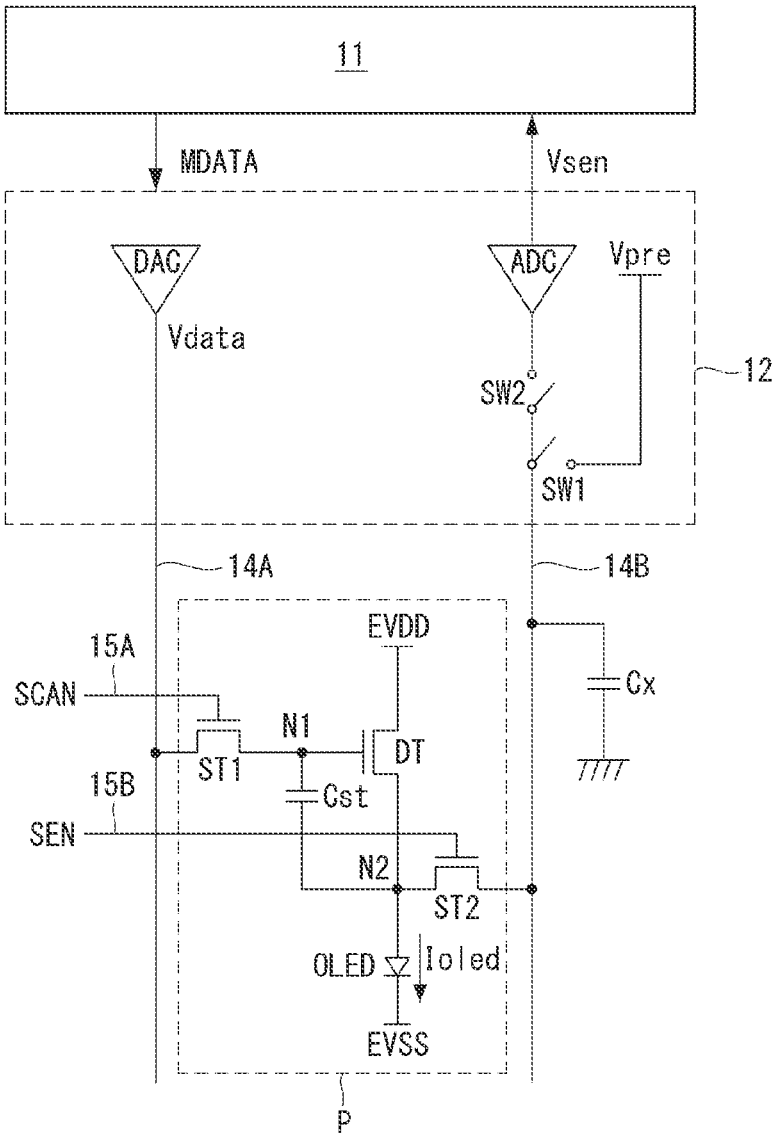
FIG. 5 illustrates a connection structure of a timing controller, a data driving circuit, and pixels along with a detailed configuration of an external compensation pixel of a source follower manner.
Figure 6:
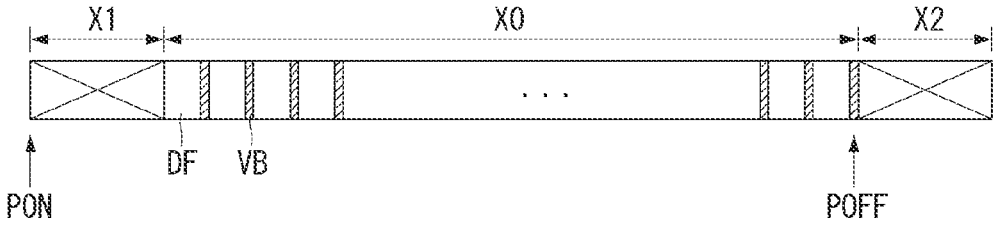
FIG. 6 shows a timing chart illustrating an image display period and non-display periods disposed on both sides of the image display period.

FIG. 5 illustrates an example connection structure of the timing controller, the data driving circuit, and the pixels along with a detailed configuration of an external compensation pixel of a source follower manner. FIG. 6 shows an example image display period and non-display periods disposed on both sides of the image display period.

As shown in FIG. 5, the pixel P may include an OLED, a driving TFT DT, a storage capacitor Cst, a first switch TFT ST1, and a second switch TFT ST2.

The OLED may include an anode electrode connected to a second node N2, a cathode electrode connected to an input terminal of a low potential driving voltage EVSS, and an organic compound layer positioned between the anode electrode and the cathode electrode.

The driving TFT DT may control a driving current Ioled flowing in the OLED depending on a gate-source voltage Vgs of the driving TFT DT. The driving TFT DT may include a gate electrode connected to a first node N1, a drain electrode connected to an input terminal of a high potential driving voltage EVDD, and a source electrode connected to the second node N2.

The storage capacitor Cst may be connected between the first node N1 and the second node N2.

In the sensing drive, the first switch TFT ST1 may apply a threshold voltage sensing data voltage Vdata charged to the data voltage supply line 14A to the first node N1 in response to a first threshold voltage sensing gate pulse SCAN. In the image display drive, the first switch TFT ST1 may apply an image display data voltage Vdata charged to the data voltage supply line 14A to the first node N1 in response to a first image display gate pulse SCAN. The first switch TFT ST1 may include a gate electrode connected to the first gate line 15A, a drain electrode connected to the data voltage supply line 14A, and a source electrode connected to the first node N1.

In the sensing drive, the second switch TFT ST2 may turn on a current flow between the second node N2 and the sensing voltage readout line 14B in response to a second threshold voltage sensing gate pulse SEN, thereby storing a source voltage of the second node N2, which is changed by following a gate voltage of the first node N1 in the source follower manner, in a sensing capacitor Cx of the sensing voltage readout line 14B. In one example, the sensing capacitor Cx may be implemented by a parasitic capacitor of the sensing voltage readout line 14B. In the image display drive, the second switch TFT ST2 may turn on a current flow between the second node N2 and the sensing voltage readout line 14B in response to a second image display gate pulse SEN, thereby resetting a source voltage of the driving TFT DT to an initialization voltage Vpre. A gate electrode of the second switch TFT ST2 may be connected to the second gate line 15B, a drain electrode of the second switch TFT ST2 may be connected to the second node N2, and a source electrode of the second switch TFT ST2 may be connected to the sensing voltage readout line 14B.

The data driving circuit 12 may be connected to the pixel P through the data voltage supply line 14A and the sensing voltage readout line 14B. The sensing capacitor Cx for storing the source voltage of the second node N2 as the sensing voltage Vsen may be formed on the sensing voltage readout line 14B. The data driving circuit 12 may include a digital-to-analog converter (DAC), an analog-to-digital converter (ADC), an initialization switch SW1, and a sampling switch SW2.

In the first and second periods of the sensing period, the DAC may generate the threshold voltage sensing data voltages Vdata at the same level or different levels under the control of the timing controller 11 and may output the threshold voltage sensing data voltages Vdata to the data voltage supply line 14A. In an image display period, the DAC may convert digital compensation data into an image display data voltage Vdata under the control of the timing controller 11 and may output the image display data voltage Vdata to the data voltage supply line 14A.

The initialization switch SW1 may turn on a current flow between an input terminal of the initialization voltage Vpre and the sensing voltage readout line 14B. The sampling switch SW2 may turn on a current flow between the sensing voltage readout line 14B and the ADC. The ADC may convert the analog sensing voltage Vsen stored in the sensing capacitor Cx into a digital value and supplies this digital sensing voltage Vsen to the timing controller 11.

A process for detecting the sensing voltage Vsen deciding a change in the threshold voltage of the driving TFT DT from each pixel P is additionally described below with reference to FIGS. 5 and 6.

When the first and second threshold voltage sensing gate pulses SCAN and SEN of an on-level Lon are applied to the pixel P for the sensing drive of the threshold voltage, the first switch TFT ST1 and the second switch TFT ST2 may be turned on. In this example, the initialization switch SW1 inside the data driving circuit 12 is turned on. When the first switch TFT ST1 is turned on, the threshold voltage sensing data voltages Vdata is supplied to the first node N1. When the initialization switch SW1 and the second switch TFT ST2 are turned on, the initialization voltage Vpre is supplied to the second node N2. In this example, because the gate-source voltage Vgs of the driving TFT DT is greater than the threshold voltage Vth of the driving TFT DT, the current Ioled (Ids) flows between the drain electrode and the source electrode of the driving TFT DT. A source voltage VN2 of the driving TFT DT charged to the second node N2 gradually increases due to the current Ioled (Ids). Hence, until the gate-source voltage Vgs of the driving TFT DT becomes the threshold voltage Vth of the driving TFT DT, the source voltage VN2 of the driving TFT DT follows a gate voltage VN1 of the driving TFT DT.

The gradually increasing source voltage VN2 of the driving TFT DT at the second node N2 may be stored in the sensing capacitor Cx formed on the sensing voltage readout line 14B as the sensing voltage Vsen via the second switch TFT ST2. The sensing voltage Vsen may be detected when the sampling switch SW2 inside the data driving circuit 12 is turned on in the sensing period, in which the second threshold voltage sensing gate pulse SEN is maintained at the on-level Lon. The detected sensing voltage Vsen may be supplied to the ADC.

Figure 7:
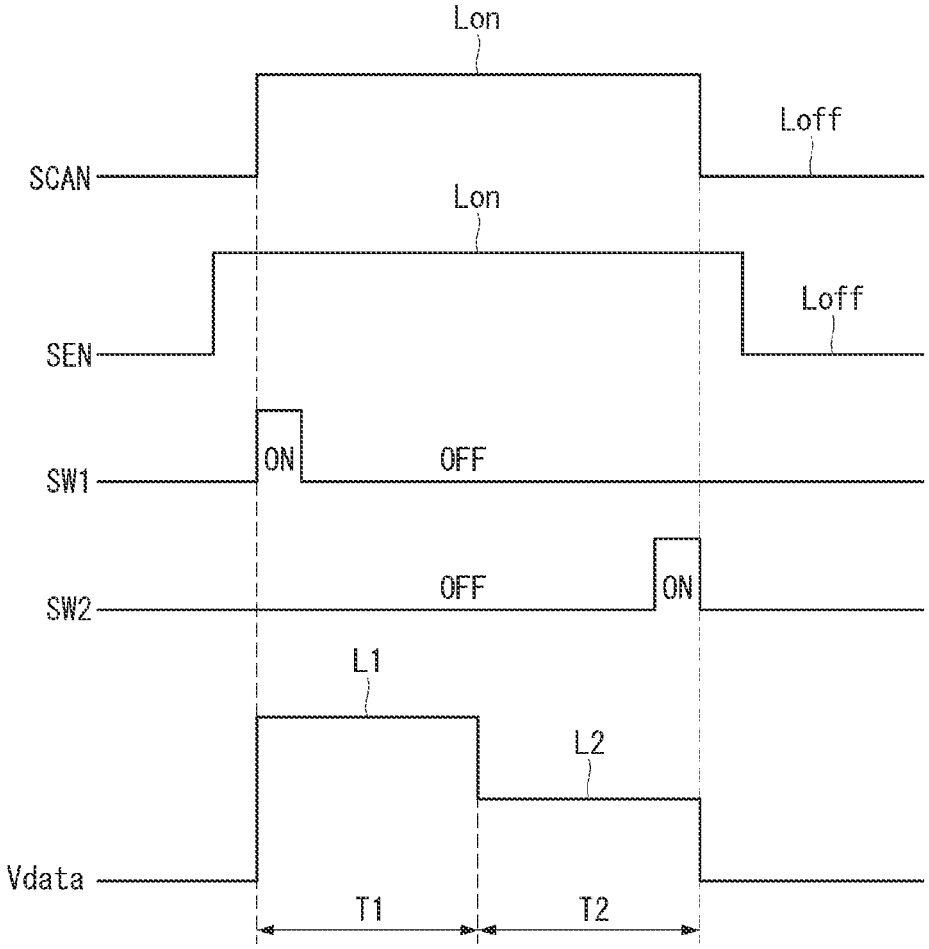
FIG. 7 shows a timing diagram illustrating, as a method for holding a gate voltage of a driving TFT at a high level in a first period of a sensing period, and holding the gate voltage of the driving TFT at a reference level in a second period following the first period, an example of inputting a threshold voltage sensing data voltage at a first level in the first period and inputting the threshold voltage sensing data voltage at a second level lower than the first level in the second period.
Figure 8:
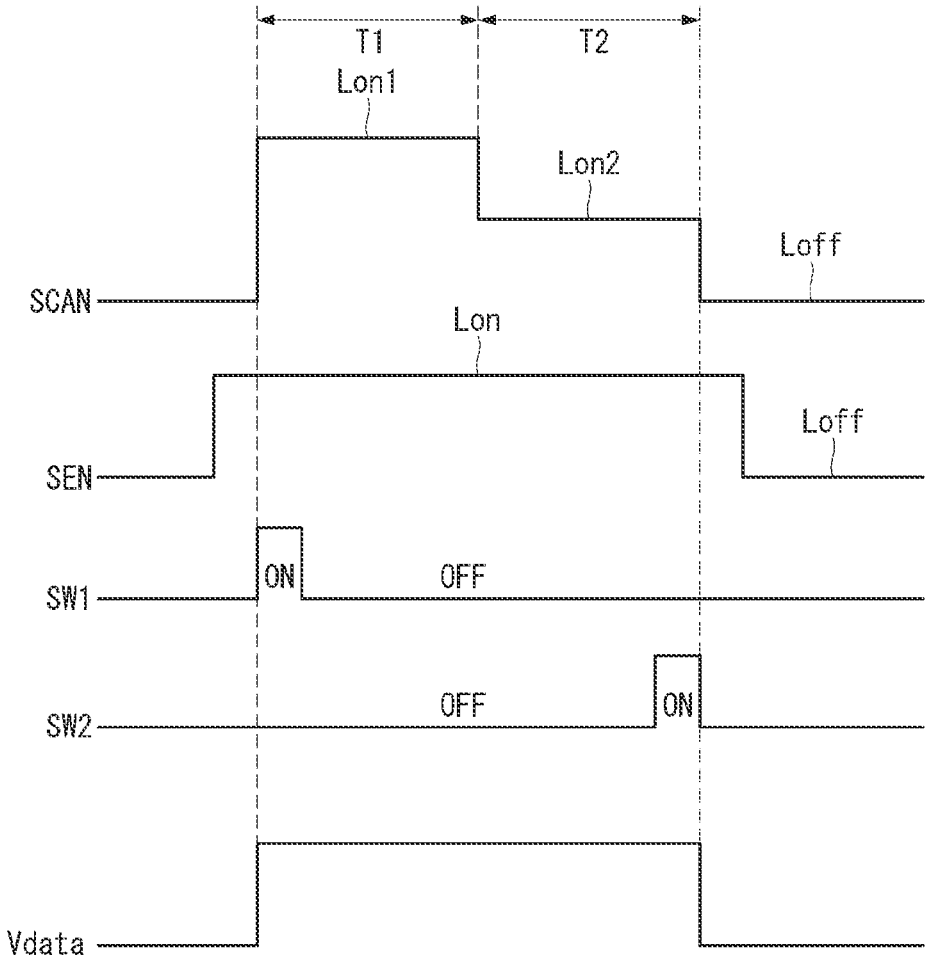
FIG. 8 shows a timing diagram illustrating, as another method for holding a gate voltage of a driving TFT at a high level in a first period of a sensing period, and holding the gate voltage of the driving TFT at a reference level in a second period following the first period, an example of inputting a threshold voltage sensing gate pulse at a first level in the first period and inputting the threshold voltage sensing gate pulse at a second level lower than the first level in the second period.

In the external compensation using the source follower manner, an embodiment of the invention may hold the gate voltage of the driving TFT at one or more high levels in the first period of the sensing period, thereby reducing the sensing time of the threshold voltage. For this, an example embodiment of the invention may modulate the threshold voltage sensing data voltage Vdata as shown in FIG. 7, or may modulate the first threshold voltage sensing gate pulse SCAN as shown in FIG. 8. This is described in detail below with reference to FIGS. 7 and 8.

As shown in FIG. 6, the threshold voltage sensing according to an embodiment of the invention may be performed in at least one of a first non-display period X1 arranged prior to an image display period X0 and a second non-display period X2 arranged after the image display period X0. Furthermore, because the sensing period of the threshold voltage according to an embodiment of the invention may be greatly reduced as compared with the related art, the sensing of the threshold voltage may be partially performed in vertical blank periods VB belonging to the image display period X0. In example embodiments disclosed herein, the vertical blank periods VB are defined as periods between adjacent display frames DF. The first non-display period X1 may be defined as a period until several tens to several hundreds of frames passed from an application time point of a driving power enable signal PON. The second non-display period X2 may be defined as a period until several tens to several hundreds of frames passed from an application time point of a driving power disable signal POFF.

Figure 9A:
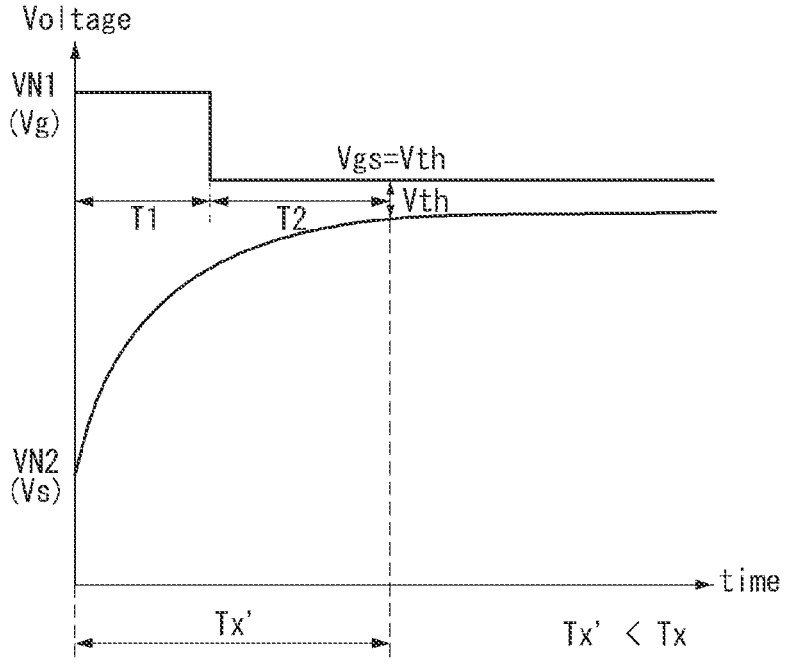
FIGS. 9A to 9C are waveform diagrams showing changes in a gate-source voltage of a driving TFT according to an example embodiment of the invention.
Figure 9B:
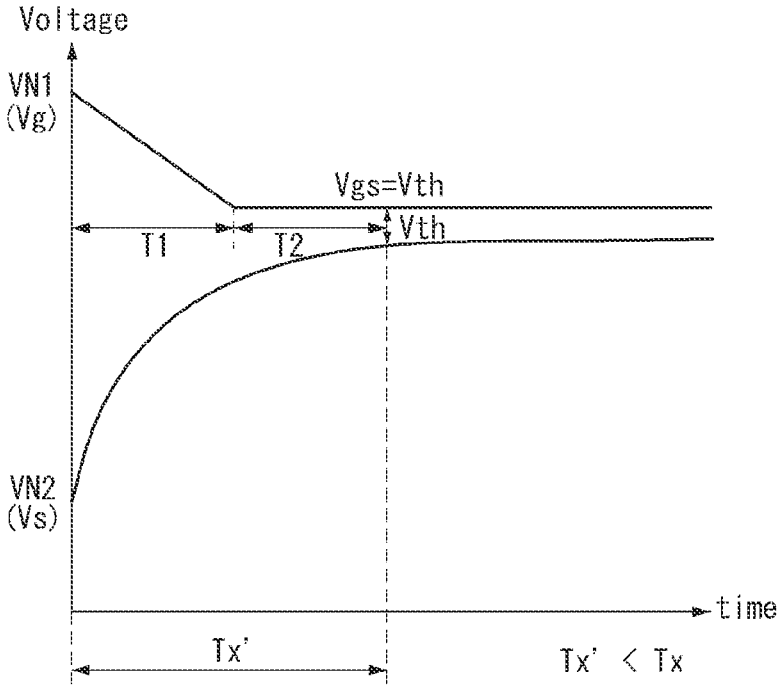
Figure 9C:
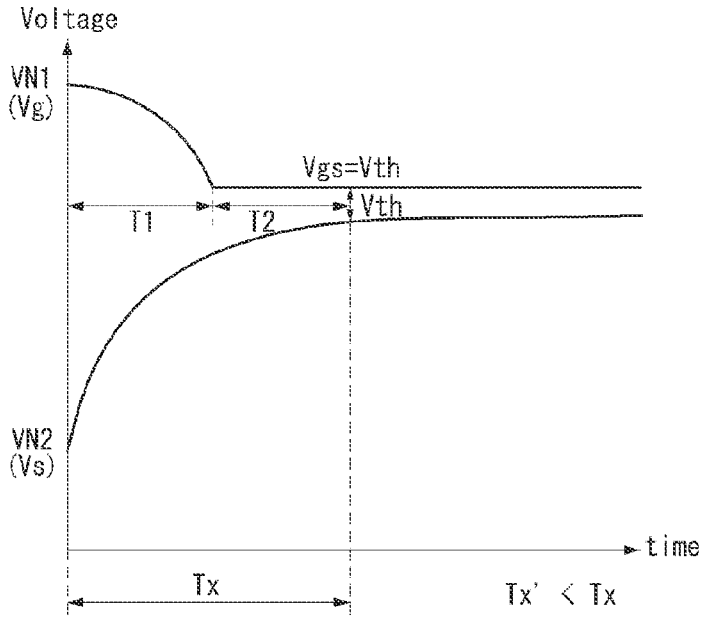

FIG. 7 shows a method for holding the gate voltage of the driving TFT at the high level in the first period of the sensing period and holding the gate voltage of the driving TFT at the reference level in the second period following the first period. FIG. 8 shows another method for holding the gate voltage of the driving TFT at the high level in the first period of the sensing period and holding the gate voltage of the driving TFT at the reference level in the second period following the first period. FIGS. 9A to 9C are waveform diagrams showing changes in the gate-source voltage of the driving TFT according to an example embodiment of the invention.

An example embodiment of the invention may increase the gate-source voltage of the driving TFT in an initial sensing period and reduce the channel resistance of the driving TFT. Further, the example embodiment may increase the drain-source current of the driving TFT in the initial sensing period, so that the source voltage of the driving TFT rapidly follows the gate voltage of the driving TFT. Hence, the time required to sense the threshold voltage of the driving TFT may be reduced.

Example embodiments of the invention may use at least one of the methods shown in FIGS. 7 and 8, so as to increase the gate-source voltage of the driving TFT in the initial sensing period.

As shown in FIG. 7, an embodiment of the invention may input the threshold voltage sensing data voltage Vdata at a first level L1 in a first period T1 of a sensing period, and may input the threshold voltage sensing data voltage Vdata at a second level L2 lower than the first level L1 in a second period T2 of the sensing period. In an example, the first threshold voltage sensing gate pulse SCAN may be input at the same on-level in the first and second periods T1 and T2 of the sensing period. The threshold voltage sensing data voltage Vdata of the first level L1 is applied to the gate electrode of the driving TFT DT in the first period T1 and thus makes the gate voltage VN1 (Vg) of the driving TFT DT at a high level as shown in FIGS. 9A to 9C. In example embodiments disclosed herein, the high level may be implemented as one voltage level as shown in FIG. 9A, or may be implemented as a plurality of voltage levels as shown in FIGS. 9B and 9C. The gate voltage VN1 (Vg) of the driving TFT DT may be maintained at a reference level lower than the high level in the second period T2 of the sensing period.

As shown in FIG. 8, an embodiment of the invention may input the first threshold voltage sensing gate pulse SCAN at a first on-level Lon1 in the first period T1 of the sensing period, and may input the first threshold voltage sensing gate pulse SCAN at a second on-level Lon2 lower than the first on-level Lon1 in the second period T2 of the sensing period. In an example, the threshold voltage sensing data voltage Vdata may be input at the same level in the first and second periods T1 and T2 of the sensing period. The first threshold voltage sensing gate pulse SCAN of the first on-level Lon1 is applied to the gate electrode of the first switch TFT ST1 and reduces the channel resistance of the first switch TFT ST1, thereby increasing an amount of the drain-source current of the first switch TFT ST1. Thus, the threshold voltage sensing data voltage Vdata applied to the gate electrode of the driving TFT DT through the first switch TFT ST1 in the first period T1 may be relatively larger than that in the second period T2. As a result, the gate voltage VN1 (Vg) of the driving TFT DT in the first period T1 has the high level as shown in FIGS. 9A to 9C. In an embodiment disclosed herein, the high level may be implemented as one voltage level as shown in FIG. 9A, or may be implemented as a plurality of voltage levels as shown in FIGS. 9B and 9C. The gate voltage VN1 (Vg) of the driving TFT DT may be maintained at the reference level lower than the high level in the second period T2 of the sensing period.

Figure 1:
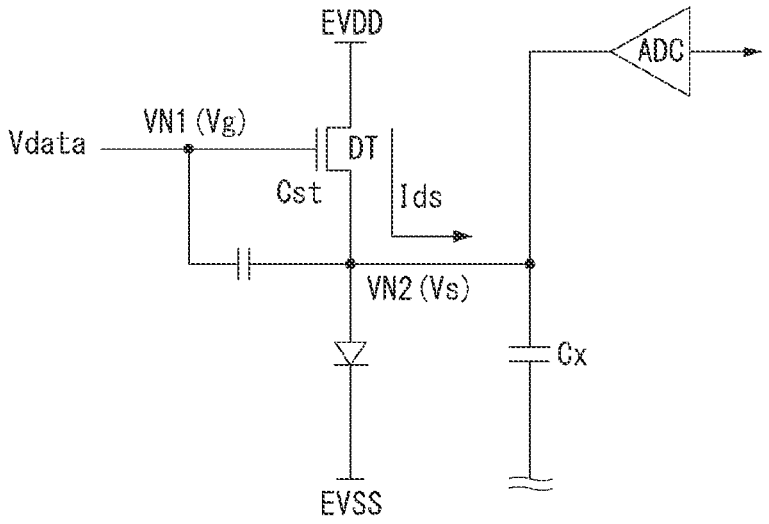
FIG. 1 (RELATED ART)
FIG. 1 is an equivalent circuit diagram of a pixel operating in a related art source follower manner.
Figure 2:
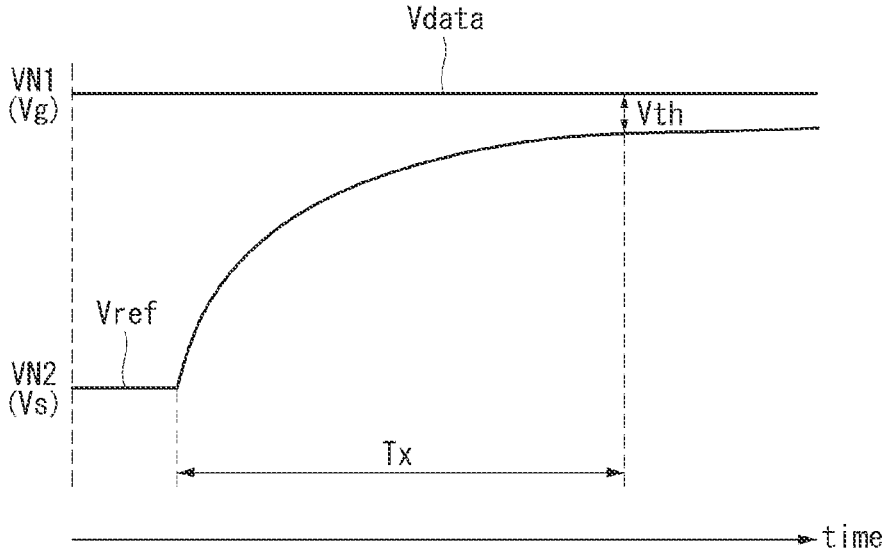
FIG. 2 (RELATED ART)
FIG. 2 is a waveform diagram showing changes in a gate-source voltage of a driving thin film transistor (TFT) shown in FIG. 1 when a threshold voltage of the driving TFT is sensed.

According to embodiments of the invention, a threshold voltage sensing period Tx' may be much shorter than the related art threshold voltage sensing period Tx (FIG. 2) through the above description.

Figure 10:
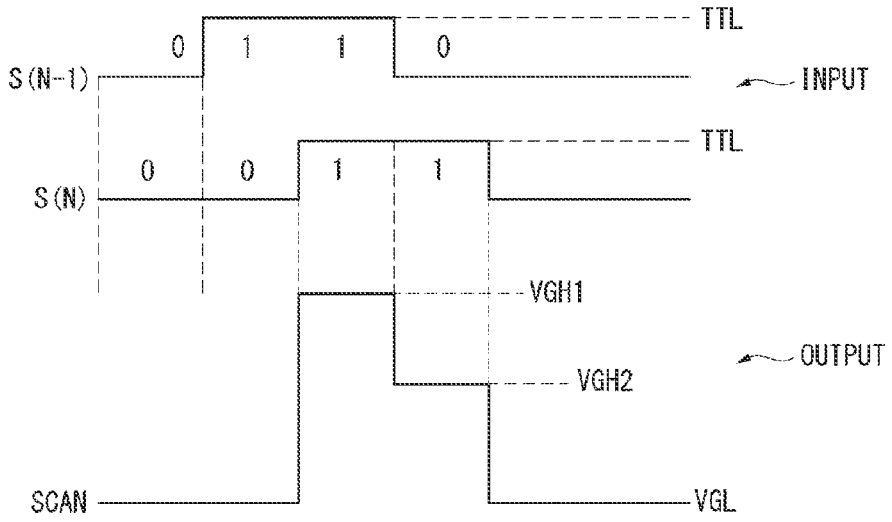
FIGS. 10 and 11 show a method for generating a first threshold voltage sensing gate pulse at a multi-on level, FIG. 10 illustrating a timing diagram and FIG. 11 showing a circuit diagram.
Figure 11:
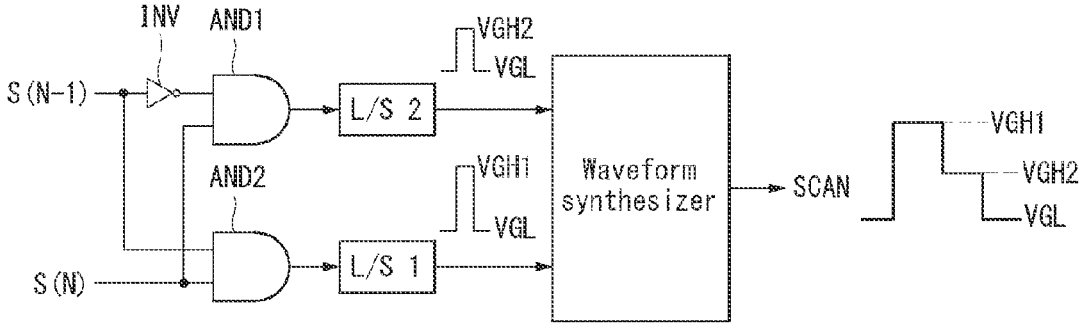

FIGS. 10 and 11 show a method for generating the first threshold voltage sensing gate pulse at a multi-on level.

As shown in FIGS. 10 and 11, the gate driving circuit according to an example embodiment of the invention may generate the first threshold voltage sensing gate pulse SCAN of a multi-on level based on adjacent clock signals S(N−1) and S(N), which partially overlap each other. For this, the gate driving circuit according to the example embodiment may include an inverter INV, a first AND gate AND1, a second AND gate AND2, a first level shifter L/S 1, a second level shifter L/S 2, and a waveform synthesizer.

In this example, the inverter INV inverts the (N−1)th clock signal S(N−1) of a TTL level. The first AND gate AND1 performs an AND operation on the (N−1)th clock signal S(N−1) passing through the inverter INV and the Nth clock signal S(N). The second AND gate AND2 performs an AND operation on the (N−1)th clock signal S(N−1), which does not pass through the inverter INV, and the Nth clock signal S(N). The first level shifter L/S 1 level-shifts an operation result of the second AND gate AND2 having the TTL level into a first on-level VGH1 and an off-level VGL. The second level shifter L/S 2 level-shifts an operation result of the first AND gate AND1 having the TTL level into a second on-level VGH2 and the off-level VGL. In example embodiments disclosed herein, the first on-level VGH1 is higher than the second on-level VGH2. The waveform synthesizer synthesizes a signal received from the first level shifter L/S 1 and a signal received from the second level shifter L/S 2 and generates the first threshold voltage sensing gate pulse SCAN of the multi-on level having the first on-level VGH1 and the second on-level VGH2.

Figure 12:
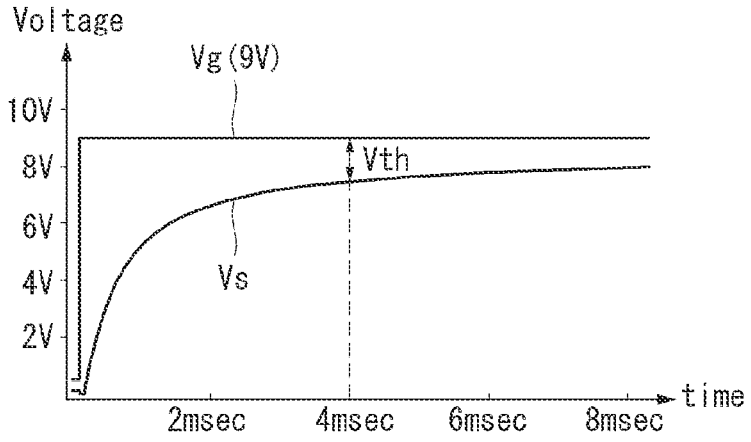
FIG. 12 shows a reduction in a sensing time required to sense a threshold voltage of a driving TFT according to an example embodiment of the invention, as compared with related art.
Figure 12:
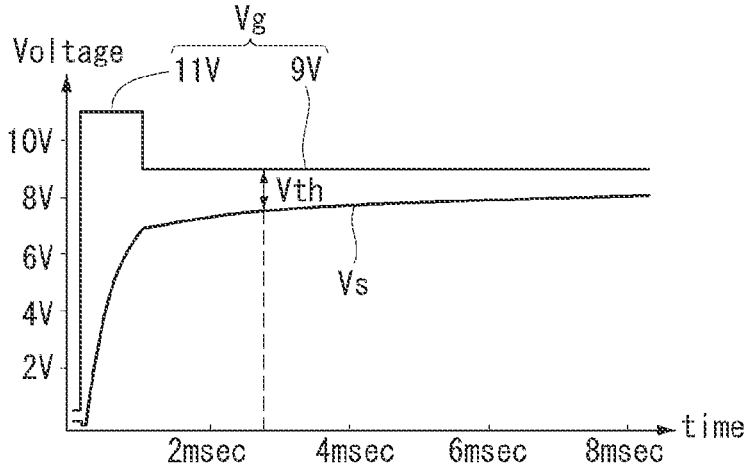

FIG. 12 shows a reduction in a sensing time required to sense the threshold voltage of the driving TFT according to an example embodiment of the invention, as compared with the related art.

As shown in FIG. 12, related art changes the source voltage Vg using the source follower manner in a state where the gate voltage Vg of the driving TFT is uniformly held at a predetermined level (for example, 9V), and senses the threshold voltage Vth of the driving TFT. As a result, in the example related art shown here, the time required to sense the threshold voltage Vth of the driving TFT was 4.12 msec, which is relatively long.

On the other hand, example embodiments of the invention do not uniformly hold the gate voltage of the driving TFT at a predetermined level throughout the sensing period. For example, an example embodiment holds the gate voltage of the driving TFT at the high level (for example, 11V) in the initial period of the sensing period and holds the gate voltage of the driving TFT at the reference level (for example, 9V) lower than the high level in the remaining period of the sensing period. As a result, in the example embodiment, the time required to sense the threshold voltage Vth of the driving TFT may be 2.77 msec, which is greatly reduced as compared with the related art.

As described above, embodiments of the invention control the gate voltage of the driving TFT at the multi-level when sensing the threshold voltage of the driving TFT using the source follower manner, thereby greatly reducing time required to sense the threshold voltage of the driving TFT.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising:

a display panel including a plurality of pixels;

a gate driving circuit configured to generate a first threshold voltage sensing gate pulse and a second threshold voltage sensing gate pulse;

a data driving circuit configured to supply a threshold voltage sensing data voltage to the pixels in response to the first threshold voltage sensing gate pulse, and detect a source voltage of a driving thin film transistor (TFT) of each pixel as a sensing voltage in response to the second threshold voltage sensing gate pulse; and a timing controller configured to modulate input digital video data for the image display based on a change in a threshold voltage of the driving TFT, and generate digital compensation data, wherein the display is configured to determine the threshold voltage of the driving TFT based on the sensing voltage, wherein a sensing period for sensing the threshold voltage of the driving TFT is divided into a first period and a second period following the first period, and wherein a gate voltage of the driving TFT of each pixel is held at one or more high levels in the first period of the sensing period, and is held at a reference level lower than the high level in the second period of the sensing period, and wherein the gate driving circuit is further configured to generate the first threshold voltage sensing gate pulse at the same or different on-levels in the first and second periods.

2. The organic light emitting display of claim 1, wherein:

the data driving circuit is further configured to supply the threshold voltage sensing data voltage of different levels to the pixel in the first and second periods; and the gate driving circuit is further configured to generate the first threshold voltage sensing gate pulse at the same on-level in the first and second periods.

3. The organic light emitting display of claim 2, wherein the data driving circuit is further configured to supply the threshold voltage sensing data voltage of a first level to the pixel in the first period, and supply the threshold voltage sensing data voltage of a second level, which is lower than the first level, to the pixel in the second period.

4. The organic light emitting display of claim 1, wherein:

the gate driving circuit is further configured to generate the first threshold voltage sensing gate pulse at different on-levels in the first and second periods; and the data driving circuit is further configured to supply the threshold voltage sensing data voltage of the same level to the pixel in the first and second periods.

5. The organic light emitting display of claim 4, wherein the gate driving circuit is further configured to generate the first threshold voltage sensing gate pulse at a first on-level in the first period, and generate the first threshold voltage sensing gate pulse at a second on-level lower than the first on-level in the second period.

6. The organic light emitting display of claim 1, wherein each pixel includes:

the driving TFT including a gate electrode connected to a first node, a source electrode connected to a second node, and a drain electrode connected to an input terminal of a high potential driving voltage;

an organic light emitting diode (OLED) connected between the second node and an input terminal of a low potential driving voltage;

a storage capacitor connected between the first node and the second node;

a first switch TFT which is connected between a data voltage supply line charged to the threshold voltage sensing data voltage and the first node and is turned on or off in response to the first threshold voltage sensing gate pulse; and a second switch TFT which is connected between a sensing voltage readout line charging the sensing voltage and the second node and is turned on or off in response to the second threshold voltage sensing gate pulse, wherein the first and second switch TFTs are turned on in the first and second periods.

7. The organic light emitting display of claim 1, wherein the display senses the sensing voltage at the end of the sensing period to thereby determine the threshold voltage.

8. The organic light emitting display of claim 1, wherein the pixels are operated in a source follower manner.

9. A method of compensating for a threshold voltage of an organic light emitting display including a display panel including a plurality of pixels, the method comprising:

generating a first threshold voltage sensing gate pulse and a second threshold voltage sensing gate pulse;

supplying a threshold voltage sensing data voltage to the pixels in response to the first threshold voltage sensing gate pulse;

detecting a source voltage of a driving thin film transistor (TFT) of each pixel as a sensing voltage in response to the second threshold voltage sensing gate pulse; and modulating input digital video data for the image display based on a change in a threshold voltage of the driving TFT and generating digital compensation data, wherein the threshold voltage of the driving TFT is determined based on the sensing voltage, wherein a sensing period for sensing the threshold voltage of the driving TFT is divided into a first period and a second period following the first period, and wherein a gate voltage of the driving TFT of each pixel is held at one or more high levels in the first period of the sensing period and is held at a reference level lower than the high level in the second period of the sensing period, and wherein the first threshold voltage sensing gate pulse is generated at the same or different on-levels in the first and second periods.

10. The method of claim 9, wherein:

the threshold voltage sensing data voltage is supplied to the pixel at different levels in the first and second periods; and the first threshold voltage sensing gate pulse is generated at the same on-level in the first and second periods.

11. The method of claim 10, wherein the threshold voltage sensing data voltage of a first level is supplied to the pixel in the first period, and the threshold voltage sensing data voltage of a second level, which is lower than the first level, is supplied to the pixel in the second period.

12. The method of claim 9, wherein:

the first threshold voltage sensing gate pulse is generated at different on-levels in the first and second periods; and the threshold voltage sensing data voltage is supplied to the pixel at the same level in the first and second periods.

13. The method of claim 12, wherein the first threshold voltage sensing gate pulse is generated at a first on-level in the first period and is generated at a second on-level lower than the first on-level in the second period.

14. The method of claim 9, wherein the pixels are operated in a source follower manner.

15. The method of claim 9, further comprising:

sensing the sensing voltage at the end of the sensing period to determine the threshold voltage.

* * * * *